US009132667B2

(12) United States Patent
Conesa et al.

(10) Patent No.: US 9,132,667 B2
(45) Date of Patent: Sep. 15, 2015

(54) PRINTING SYSTEM

(75) Inventors: Eduardo Amela Conesa, Lleida (ES); Jaime Fernandez, Barcelona (ES); Jacint Humet, Barcelona (ES); Marc Serra, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/125,912

(22) PCT Filed: Jun. 15, 2011

(86) PCT No.: PCT/US2011/040486

§ 371 (c)(1),
(2), (4) Date: Dec. 12, 2013

(87) PCT Pub. No.: WO2012/173613

PCT Pub. Date: Dec. 20, 2012

(65) Prior Publication Data

US 2014/0160214 A1 Jun. 12, 2014

(51) Int. Cl.

| | |
|---|---|
| ***B41J 29/38*** | (2006.01) |
| ***B41J 2/17*** | (2006.01) |
| ***B41J 11/00*** | (2006.01) |
| ***B41J 2/21*** | (2006.01) |

(52) U.S. Cl.
CPC ..... *B41J 11/0015* (2013.01); *B41J 2/2114* (2013.01)

(58) Field of Classification Search
CPC ..... B41J 11/0015; B41J 2/21; B41J 2/211; B41J 2/2114; B41M 5/0011
See application file for complete search history.

(56) References Cited

U.S. PATENT DOCUMENTS

| | | | | |
|---|---|---|---|---|
| 5,012,257 | A | 4/1991 | Lowe et al. | |
| 6,443,568 | B1 | 9/2002 | Askeland et al. | |
| 6,561,610 | B2 | 5/2003 | Yamasaki et al. | |
| 7,530,683 | B2 | 5/2009 | Bauer | |
| 2004/0048001 | A1 | 3/2004 | Kiguchi et al. | |
| 2005/0106365 | A1 * | 5/2005 | Palmer et al. | 428/195.1 |
| 2005/0206711 | A1 | 9/2005 | Milini | |
| 2006/0066662 | A1 | 3/2006 | Kadomatsu et al. | |
| 2010/0194805 | A1 | 8/2010 | Houjou | |
| 2010/0288163 | A1 | 11/2010 | Valentini | |
| 2010/0293725 | A1 | 11/2010 | Hermann | |

FOREIGN PATENT DOCUMENTS

| | | | |
|---|---|---|---|
| CN | 1113078 | A | 12/1995 |
| CN | 101885266 | A | 11/2010 |
| JP | 10119320 | | 12/1998 |
| JP | 2004167996 | | 6/2004 |
| JP | 2007021886 | | 2/2007 |
| JP | 2007069378 | | 3/2007 |

OTHER PUBLICATIONS

PCT, Search Report, PCT/US2011/040486, Feb. 9, 2012, 8 pages.

* cited by examiner

*Primary Examiner* — Shelby Fidler
*Assistant Examiner* — Tracey McMillion
(74) *Attorney, Agent, or Firm* — Dicke, Billig & Czaja, PLLC

(57) ABSTRACT

A printing method and system include a printhead configured to eject a fixer fluid. A controller is operatively connected to the printhead and configured to control the printhead so as to apply the fixer fluid to a print area in a pattern to form cells having a predetermined area without the fixer fluid.

12 Claims, 2 Drawing Sheets

PRINTING SYSTEM

BACKGROUND

Some printing systems use a fixer fluid, which can be used to pretreat a print medium. For example, an ink jet printer forms a printed image by printing a pattern of individual dots at particular locations of an array defined for the printing medium. The locations are conveniently visualized as being small dots in a rectilinear array. The locations are sometimes dot locations, dot positions, or pixels. Thus, the printing operation can be viewed as the filling of a pattern of dot locations with dots of ink.

A fixer fluid is sometimes used to pretreat the print medium, which can address coalescence, bleed, or other similar defects characterized by ink or pigment migration across the printed surface. Pretreatment fluids are often applied as a uniform layer before printing, with common application methods including roll coating, spray coating, and manually applying the pretreatment on the print medium prior to printing an image on the print medium.

Pretreating print media with a fixer fluid can have drawbacks, such as a causing a reduction in gloss of the printed image, as well as increasing the total amount of fluid vehicle that will have to be evaporated prior to ink curing.

DETAILED DESCRIPTION

In the following detailed description, reference is made to the accompanying drawings which form a part hereof, and in which is shown by way of illustration various examples in which the invention may be practiced. In this regard, directional terminology, such as "top," "bottom," "front," "back," "leading," "trailing," etc., is used with reference to the orientation of the Figure(s) being described. Because disclosed components can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Certain printing systems use a fixer fluid, which can be used to pretreat a print medium in an attempt to improve printed image quality (IQ) by addressing coalescence, bleed, or other similar defects characterized by ink or pigment migration across the printed surface. Accordingly, some printers include a system for applying such a fixer fluid in addition to the other printing fluids, such as black and other colored ink for forming images on a print medium.

For example, ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times corresponding to the pattern of pixels of the image being printed. The print medium is typically held stationary while the printheads complete a "print swath." The print medium is then advanced and the carriage again moves across the print medium to print on the next portion of the medium.

Color ink jet printers commonly employ a plurality of printheads mounted in the print carriage to produce different colors. Each printhead contains ink of a different color, with commonly used colors including cyan, magenta, yellow, and black. These base colors are produced by depositing a drop of the required color onto a dot location. Secondary or shaded colors are formed by depositing drops of different colors on adjacent dot locations; the human eye interprets the color mixing as the secondary or shading, through well known optical principles. An additional printhead may be provided for depositing a fixer, or pretreatment fluid.

Figure 1:
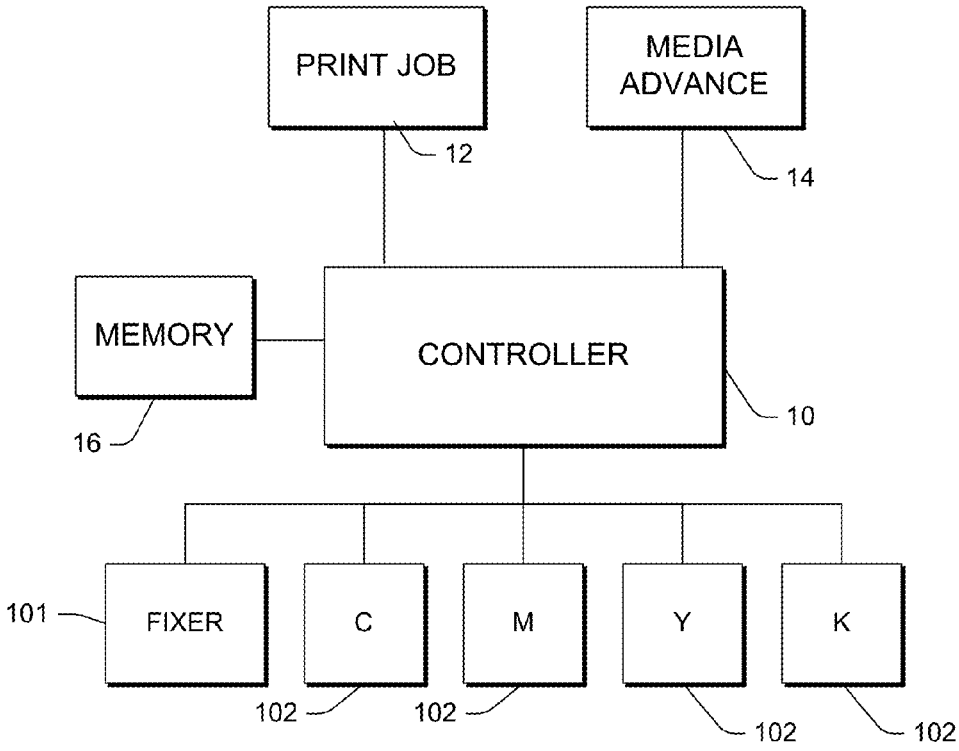
FIG. 1 is block diagram conceptually illustrating aspects of an example of an ink jet printer.

FIG. 1 is block diagram illustrating aspects of an example of an ink jet printer. A controller 10 receives print job commands and data from a print job source 12, which can be a computer system or other source of print jobs. The controller 10 acts on the received commands to provide control signals to a media advance device 14 to advance a print medium such as a sheet of paper to a print zone where it receives ink to create an image. As the print medium is advanced, firing pulses are sent to a plurality of printheads, or pens in response to control signals received from the controller. The illustrated example has five printheads, which include a fixer fluid printhead 101 and a plurality of color ink printheads 102. In the illustrated version, the color printheads include cyan (C), magenta (M), yellow (Y) and black (K) ink printheads.

The controller 10 may be implemented, for example, by one or more discrete modules (or data processing components) that are not limited to any particular hardware, firmware, or software configuration. The controller 10 may be implemented in any computing or data processing environment, including in digital electronic circuitry (e.g., an application-specific integrated circuit, such as a digital signal processor (DSP)) or in computer hardware, firmware, device driver, or software. In some implementations, the functionalities of the modules are combined into a single data processing component. In other versions, the respective functionalities of each of one or more of the modules are performed by a respective set of multiple data processing components.

In some implementations, process instructions (e.g., machine-readable code, such as computer software) for implementing the methods that are executed by the controller 10, as well as the data it generates, are stored in a memory device 16 accessible by the controller 10. The memory device 16 may include one or more tangible machine-readable storage media. Memory devices 16 suitable for embodying these instructions and data include all forms of computer-readable memory, including, for example, semiconductor memory devices, such as EPROM, EEPROM, and flash memory devices, magnetic disks such as internal hard disks and removable hard disks, magneto-optical disks, DVD-ROM/RAM, and CD-ROM/RAM.

Figure 2:
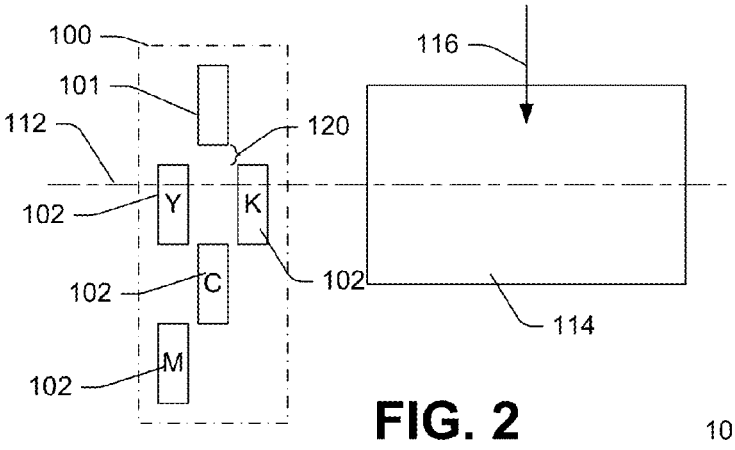
FIG. 2 is a block diagram conceptually illustrating an example of an ink jet printer printhead arrangement.

Some printhead arrangements use linear arrays of printheads, wherein the pens of different colors are situated one next to the other. Other arrangements use a staggered configuration where the color ink printheads are staggered to improve image quality by reducing ink flux per area of print media. FIG. 2 conceptually illustrates such a staggered printhead arrangement. In this diagrammatic view, a printer carriage 100 moves along a swath axis 112 over a print zone 114 of a print medium. As illustrated in FIG. 2, the swath axis 112 is horizontal, and the print medium moves on an axis perpendicular to the swath axis 112 (up and down in FIG. 2), with the media advance direction indicated by an arrow 116. The carriage 100 supports the pens 101,102 situated in a staggered arrangement wherein each of the non-black-ink pens do not overlap in the scan direction over the print zone 114. Further, the fixer pen 101 is spaced apart from the first (uppermost) color pen 102 in the direction of the media advance axis to form a gap 120. The provision of the gap 120 between the fixer pen 101 and the color pens 102 avoids cross-contamination among inks, for example.

Figure 3:
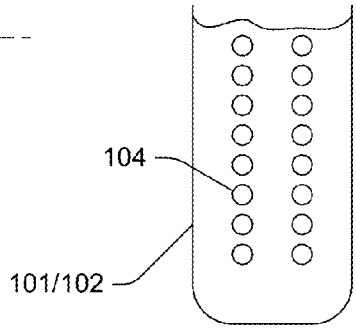
FIG. 3 is a partial view of a printhead, illustrating a portion of a nozzle array.

Each of the printheads 101, 102 includes a plurality of nozzles through which the fixer fluid and ink are ejected. The nozzles are typically arranged in one or more arrays extending in the media advance direction. FIG. 3 conceptually illustrates a portion of an example printhead having a nozzle array including two columns of nozzles 104. The length of the nozzle array defines the maximum pattern of ink that can be laid down on the media in a single pass, with the total span of the nozzle arrays defining the maximum swath height. A printer such as that disclosed herein can operate according to several different print modes. For example, in a single-pass print mode, after each printing pass the media is advanced a distance equal to the full span of the nozzle array, such that each pass forms a complete strip of the image on the print medium. In a multi-pass print mode, the swath height is smaller because the media only advances a fraction of the total length of the nozzle array after each printing pass of the printheads, and each strip of the image to be printed is formed in successive passes of the printheads. Further, printing can be unidirectional where the printheads only print when travelling in one direction along the scan axis, or it can be bidirectional where the printheads print when travelling in a "forward pass" and also when travelling in a "return pass," the print medium being advanced after each pass.

The printhead arrangement of FIG. 2 supports bidirectional swath printing without resulting in undesirable hue-shifting from a swath in a first direction and a swath in the opposite direction. As the print medium is advanced in the advance direction 116, the leading edge of the print zone 114 first encounters the fixer pen 101. A first pass of the carriage 100 over the print zone in a first direction, left-to-right for example, will use only the fixer pen 101 to lay down fixer fluid along the coverage area of its nozzle array. After the first pass, the medium is incrementally advanced by an advance distance, or swath height. A fresh area of the print medium is now positioned below the fixer pen, and the area to which the fixer fluid was applied is now below one or more of the color ink pens 102.

For the second pass of the carriage 100 in the reverse direction, (right-to-left in this example), the fixer pen 101 and the appropriate color ink pen(s) 102 are driven to apply drops of the corresponding fluid. Upon completion of the second pass, the medium is advanced by the same incremental distance, such that a fresh medium area is again below the fixer pen 101, the second area just traversed by the fixer pen 101 during the second pass is below the color ink pen 102, and the area to which both fixer and colored ink have been applied is now below another color ink pen 102. The carriage 100 again traverses the print zone 114 with the fixer pen 101 and appropriate color ink pens 102 driven to apply the corresponding fluid, and so on. For the subsequent passes over the print zone 114 until the end of the page or print job is approached, all of the color ink pens 102 driven by the controller 102 to achieve the desired color image.

Applying fixer fluid from the fixer pen 101 as a solid, uniform layer can cause a reduction in gloss of the printed image, as well as increasing the total amount of fluid vehicle that will have to be evaporated prior to ink curing. In certain implementations disclosed herein, the fixer fluid is applied to a print area of the print medium in a pattern to form cells having a predetermined area without the fixer fluid.

Figure 4:
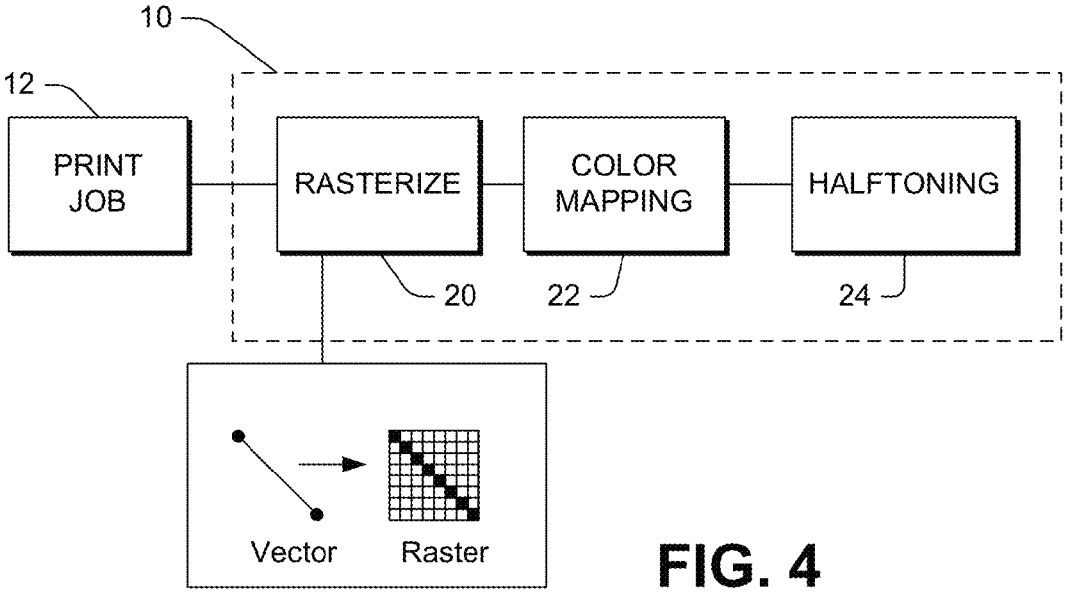
FIG. 4 is a bock diagram conceptually illustrating portions of an example printing pipeline.

FIG. 4 is an example of a portion of a printing pipeline, which may be implemented by the controller 10. The controller receives the printjob 12, which typically is in the form of vector information. The controller 12 includes a rasterization, or rendering, process 20 that converts the vector data to a pattern of pixels that when printed on the print medium create the desired image. Colormapping and halftoning processes 22,24 are additionally executed by the controller 10 for producing the desired printed colors, though these processes typically are not needed for applying the fixer fluid in the desired pattern because the lines, or borders, of the pattern are printed solid with the fixer fluid. The printheads 101,102 include nozzles 104 through which fluid is ejected to the print medium. The controller 10 is operatively connected to the printheads 101,102 to control which specific nozzles 104 of the printheads 101,102 are fired to eject fluid via a print mask. As used in this context, the "print mask" is not a physical mask but rather, logic that includes control data determining which nozzles 104 of the various printheads 101,102 are fired at a given time to eject fluid as desired. The print mask may be stored in the memory device 16.

Figure 5A:
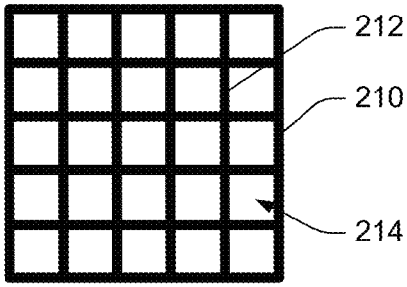
FIG. 5A illustrates a portion of an example fixer fluid application pattern.
Figure 5B:
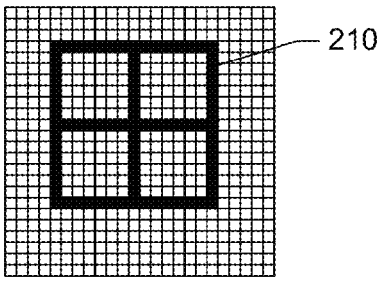
FIG. 5B is a close up view of a portion of the example pattern illustrated in FIG. 5A.

FIG. 5A illustrates an implementation in which the fixer fluid is applied in a predetermined pattern to form a simple square grid 210. FIG. 5B conceptually illustrates a portion of the grid 210 after the rasterization process, showing an example of some of the pixels to which the fixer fluid is applied to form the grid pattern 210. The borders 212 of the pattern 210 create cells 214 including areas where no fixer fluid is applied. The borders 210 isolate the cells 214 from other cells 214, and thus ink defects caused, for example, by pigment and ink migration cannot grow larger than the size of the cells 214. A smaller pattern defining smaller cells 214 may provide better reduction of defects and be less visible, but requires applying more fixer fluid. A pattern forming larger cells uses less fixer fluid but may not provide the desired IQ improvements. As used herein, the term "grid" is not necessarily limited to patterns of horizontal and vertical lines. Other periodic, or regular, patterns that could be used in further implementations include patterns forming triangular or hexagonal grids, for example. A hexagonal grid has a lower perimeter to cell area ratio and thus would require less pretreatment fluid to form the grid.

Figure 6A:
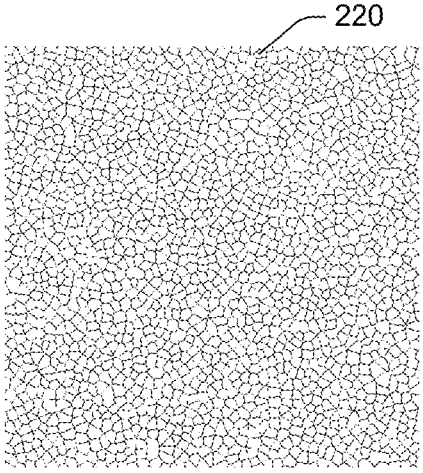
FIG. 6A illustrates a portion of another example fixer fluid application pattern.
Figure 6B:
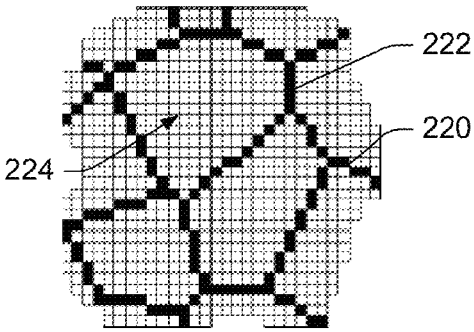
FIG. 6B is a close up view of a portion of the example pattern illustrated in FIG. 6A.

FIG. 6A illustrates an example of a pattern 220 used in another implementation. FIG. 6B is a close up view of a portion of the pattern 220, showing part of the pixel placement producing the pattern resulting from the rasterization process. The pattern 220 illustrated in FIGS. 6A and 6B is a non-periodic pattern—the cells do not repeat themselves in regular intervals or periods. A non-periodic pattern of cell borders is less visible when viewed by a user.

The non-periodic pattern 220 illustrated in FIGS. 6A and 6B has an improved perimeter to cell area ratio as compared to the regular grid 210 of FIGS. 5A and 5B. In certain implementations, the non-periodic pattern 220 is the Voronoi grid of a blue noise dither pattern of the appropriate density. The combination of features of the blue noise pattern with those of the Voronoi grid creates a sort of random hexagonal grid, which is not highly recognizable when viewed. The blue noise pattern used in some implementations actually is periodic, but it is periodic on a larger scale. At the level of the individual Voronoi grid cells, the blue noise pattern is non-periodic.

In general, some implementations use a grid of about 0.5 mm in diameter. This allows for desired coalescence control using about 25% of the total fixer fluid required to achieve a similar IQ as when fixer fluid is applied in a uniform, solid manner. Such a pattern also provides an increase in gloss without significantly degrading other IQ attributes. Because of the highly reduced amount of fixer fluid used, the negative effects of pretreating a print medium are also reduced.

In some implementations, the predetermined pattern forming the cells 214, such as the Voronoi grid, is pre-calculated and stored in the pretreatment print mask. This allows depositing the fixer fluid grid without significant modifications to a typical printing pipeline. A non-periodic pattern such as the Voronoi grid 220 can be calculated by any of a number of suitable algorithms.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A printing system, comprising:

a first printhead to eject a fixer fluid;

a second printhead to eject ink; and a controller operatively connected to the first printhead to control the first printhead to apply the fixer fluid to a print area to form cells having a predetermined area without the fixer fluid, and operatively connected to the second printhead to control the second printhead to apply the ink to the print area, the fixer fluid to contain ink within the predetermined area of a respective cell.

2. The printing system of claim 1, further comprising:

a plurality of the second printheads, each to eject ink of respective colors.

3. The printing system of claim 1, wherein:

the controller is to apply the fixer fluid in a periodic grid.

4. The printing system of claim 1, wherein:

the controller is to apply the fixer fluid in a non-periodic grid.

5. The printing system of claim 4, wherein:

the non-periodic grid is a Voronoi grid.

6. The printing system of claim 1, wherein:

the controller is to apply the fixer fluid such that the cells have a diameter of about 0.5 mm.

7. The printing system of claim 1, wherein:

the second printhead is to apply the ink after the first printhead applies the fixer fluid.

8. The printing system of claim 1, wherein:

the controller is to apply the fixer fluid to form irregular cells.

9. The printing system of claim 1, wherein:

the controller is to apply the fixer fluid to form non-patterned cells.

10. The printing system of claim 1, wherein:

the controller is to apply the fixer fluid in non-repeating intervals.

11. The printing system of claim 1, wherein:

the fixer fluid to define a border of a respective cell, and the predetermined area without the fixer fluid being within the border.

12. The printing system of claim 11, wherein:

the border of the respective cell to isolate the respective cell from other cells and prevent migration of ink within the predetermined area of the respective cell beyond the respective cell.

* * * * *